US006659545B1

(12) United States Patent
McMillan

(10) Patent No.: US 6,659,545 B1
(45) Date of Patent: Dec. 9, 2003

(54) FOAM TRAY ASSEMBLY WITH SECURITY STRAP

(76) Inventor: Susan McMillan, 11 Fords Edge S. 6th Ave., Royersford, PA (US) 19468

( * ) Notice: Subject to any disclaimer, the term of this patent is extended or adjusted under 35 U.S.C. 154(b) by 0 days.

(21) Appl. No.: 10/215,825

(22) Filed: Aug. 9, 2002

(51) Int. Cl.[7] ..... A47B 39/00

(52) U.S. Cl. ..... 297/153; 297/188.2; 297/228.13; 108/43; 5/638

(58) Field of Search ..... 297/153, 135, 297/152, 160, 188.01, 188.2, 219.12, 228.13; 108/43, 44; 5/638, 640

(56) References Cited

U.S. PATENT DOCUMENTS 3,788,699 A * 1/1974 Starr
4,143,915 A * 3/1979 Kamlay
4,453,764 A * 6/1984 Hennessy
4,770,107 A * 9/1988 Miller
5,893,331 A 4/1999 Diletto ..... 108/48
6,135,546 A 10/2000 Demtchouk ..... 297/135
6,511,124 B2 * 1/2003 Combs

* cited by examiner

*Primary Examiner*—Laurie K. Cranmer
(74) *Attorney, Agent, or Firm*—Goldstein & Lavas, P.C.

(57) ABSTRACT

A tray assembly for use with a child's booster seat in an automobile, the booster seat having a back and a pair of sides, each side having a side top, the tray assembly including a foam tray and an anchoring strap. The foam tray is made of a continuous piece of foam rubber which is covered by cloth. The foam tray has a forward portion having a cutout for accommodating the child, the cutout defining a pair of wings. The anchoring strap includes an elastic portion and a pair of anchoring pins. A pair of anchoring holes are located in the wings of the foam tray to accommodate the anchoring pins of the anchoring strap. In use, the foam tray is positioned upon the side tops of the booster seat, the anchoring strap is extended around the booster seat, and the anchoring pins are mated with the anchoring holes to thereby hold the tray securely in place upon the sides of the booster seat, immediately above the child's lap.

3 Claims, 2 Drawing Sheets

FOAM TRAY ASSEMBLY WITH SECURITY STRAP

BACKGROUND OF THE INVENTION

1. Field of the Invention

The present invention relates to a foam tray assembly with a security strap which may be anchored around a child's booster seat while traveling in an automobile. The tray assembly provides a safe, convenient, and inexpensive area upon which the child can place toys, coloring books, drinks, and other similar objects.

2. Description of Related Art

Small children who are passengers in cars often will want to play with or hold various toys, drinks, or other objects while the automobile is in motion. It is often inconvenient for a child to simply place these objects on his/her lap as the objects may slip off of the lap and would then be difficult for the child to retrieve. Furthermore, when children lose their grip on these objects, they can become flying missiles in the event of an automobile accident.

In recent years, legislation has been enacted which requires children up to a certain age and/or weight to be seated in a "booster" or "safety" seat whenever traveling within an automobile. Such constraints further inhibit children from entertaining themselves while in the automobile.

Various devices have been created which attempt to solve some of the objects of the present invention. U.S. Pat. No. 6,135,546 to Demtchouk appears to show a table attachable to the passenger seat of a vehicle secured by a belt around the backrest. However, Demtchouk has a hard tabletop surface which may injure a child, and has legs which make it incompatible with most child seats which generally closely accommodate the child and do not provide sufficient clearance to support such legs.

U.S. Pat. No. 4,707,107 to Miller appears to show a portable travel tray for use with a child's safety seat. However, Miller appears to balance the tray precariously between the front seat and the front portion of the child's seat. Movement of the front seat forward even slightly may result in dumping the contents of the tray onto the child.

U.S. Pat. No. 5,893,331 to Diletto appears to show a tray attachment which attaches onto the arm of a beach chair, lounge chair, or chaise. However, Diletto would generally be incompatible with the structure of most child seats, which have solid sides, providing no place for Diletto to "clamp on".

While these units may be suitable for the particular purpose employed, or for general use, they would not be as suitable for the purposes of the present invention as disclosed hereafter.

SUMMARY OF THE INVENTION

It is an object of this invention to provide a tray which can be used by a small child to hold various objects while riding in a booster seat of a car. Accordingly, this tray is shaped in a way that facilitates its support upon a child's lap and legs and the perimeter of a booster seat.

It is a further object of this invention to provide a tray which can be used by a small child which minimizes any risk of injury due to the tray itself, even in the event of an automobile accident. Accordingly, the tray is made from foam and cloth and it is held in place by a flexible strap which is anchored around the back of the booster seat.

It is a further object of this invention to provide a tray which makes it easier for a child to hold onto objects with which he/she is playing, and thereby avoid having to stop the car in order that the objects may be retrieved from the floor of the car or other areas. Accordingly, this tray provides a large surface upon which objects may be placed in a way that minimizes the possibility that the child looses his/her grip on the objects.

It is a further object of this invention to provide a tray which is inexpensive and easy to maintain. Accordingly, due to the foam and cloth construction, the tray is inexpensive to manufacture and can be easily cleaned by the user.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
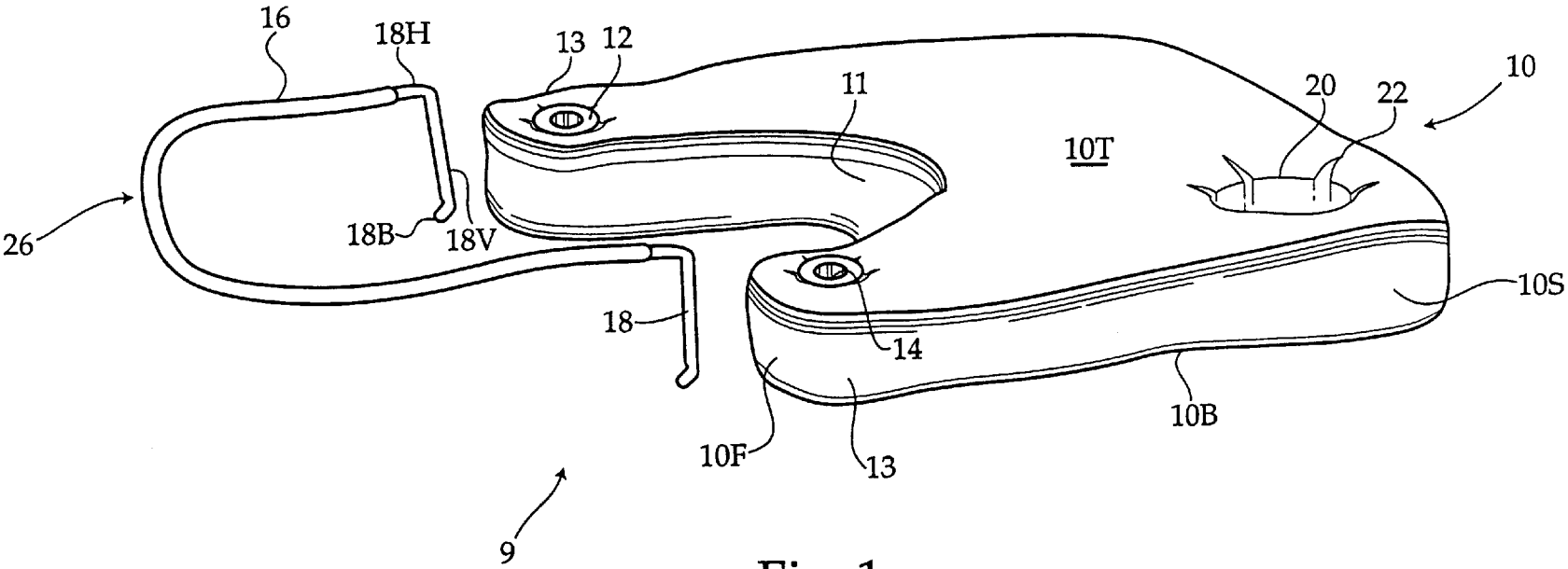
FIG. 1 is a perspective view of the cloth-covered foam tray with the associated strap which fits into anchoring holes of the tray.
Figure 2:
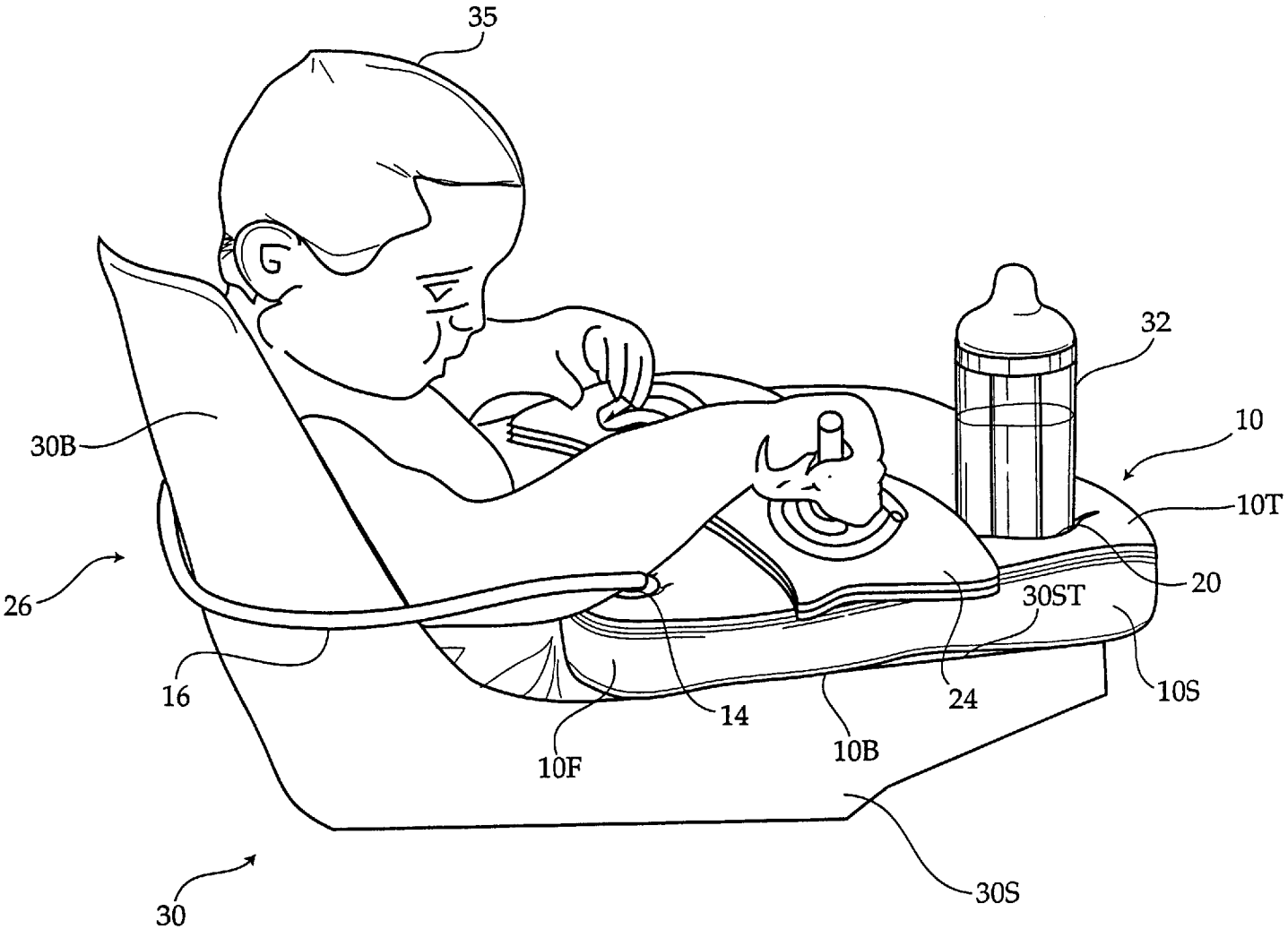
FIG. 2 is a perspective view of the cloth-covered foam tray, mounted to a booster seat, and in use wherein a child is seated in the booster seat and is using the tray.

FIG. 1 illustrates a tray assembly 9, including a cloth-covered foam tray 10 and the anchoring strap 26. The foam tray 10 is generally made of a continuous piece of foam rubber or the like, having a top surface 10T. Referring momentarily to FIG. 2, the foam tray 10 is used in conjunction with a booster seat 30 having a back 30B, and a pair of sides 30S, each having a side top 30ST. Shown in FIG. 2, a child 35 is seated within the booster seat 30 between the sides 30S.

The anchoring strap 26 has a pair of anchoring pins 18 and an elastic cord 16 which is connected to and extends between the anchoring pins 18. The foam tray 10 is mated with the anchoring strap 26 using a pair of anchoring pins 18. In particular, the foam tray 10 has a pair of anchoring holes 14 which extend vertically into the top surface 10T and are sized to accommodate the anchoring pins 18. The anchoring pins 18 have a horizontal portion 18H which is connected to and coextensive with the elastic cord 16, and a vertical portion 18V extending perpendicular to the horizontal portion 18H which extends into the anchoring holes 14. To help maintain the anchoring pins 18 within the anchoring holes 14, the anchoring pins have a bottom catch 18B which extends at a 45 degree angle to the vertical portion 18V of the anchoring strap 18 and thereby prevents the anchoring strap 26 from slipping out of the anchoring holes 14 unless the rigid portion of the anchoring strap 18 is deliberately removed from the anchoring holes 14 by an upward motion by an adult.

The anchoring holes 14 are each given added stability, rigidity and durability by the presence of an o-ring 12, made of a rigid material, which overlays the top surface 10T of the foam tray 10, around the anchoring holes 14, to prevent the anchoring pins 18 from tearing the foam. In this regard, the o-ring 12 may be substituted with a sleeve which fully encloses the anchoring pin 18 so that it does not come into contact with the foam.

The foam tray 10 has a bottle holder 20 which is a bore extending downward from the foam tray top 10T, which is hollowed-out so as to accommodate and securely hold bottles which contain liquid. The bottle holder 20 has radial slits 22 cut into its circumference so that the bottle holder may easily expand, using the natural properties of the foam to accommodate bottles of varying circumference.

The foam tray has a pair of sides 10S, a forward portion 10F, and a curved cutout 11 for allowing the tray to conform as closely to the child 35 as possible. The curved cutout 11 defines a pair of wings 13 which extend on opposite sides of the child 35. The anchoring holes 14 are located in the wings 13 near the forward portion 10F of the foam tray 10.

FIG. 2 illustrates the foam tray 10 while it is being used, with the child 35 seated therein. The upper surface of the foam tray 10T is being used to support a coloring book 24 that the child is using. The bottom portion of the foam tray 10B rests on and is supported by the sides 30S of the booster seat, and rests partially upon the child's lap and legs. A baby bottle 32 has been pushed into and is being held by the bottle holder 20. The elastic cord 16 of the anchoring strap 26 is wrapped around the back of the booster seat 30B and the anchoring pins 18 have been placed into the anchoring holes 14, thereby causing the foam tray 10 to rest securely on the child's lap.

In conclusion, herein is presented a cloth-covered foam tray with associated anchoring strap to be used by a child in an automobile. The invention is illustrated by example in the drawing figures, and throughout the written description. It should be understood that numerous variations are possible, while adhering to the inventive concept. Such variations are contemplated as being a part of the present invention.

What is claimed is:

1. A tray assembly for use by a child having a body, riding in an automobile, used in conjunction with a child's booster seat having a back and a pair of sides, for providing a surface upon which the child may conveniently and safely play, comprising:

a foam tray, having a top surface and a pair of sides, a forward portion, the forward portion having a curved cutout defining a pair of wings for allowing the tray to conform to the body of the child, and anchoring holes located in the wings, the anchoring holes extending vertically into the top surface of the tray and further comprising an o-ring made of rigid material, which is attachable to the top surface of the tray and overlays the anchoring holes; and an anchoring strap which is selectively attachable to the tray to surround the booster seat and attach the tray thereto, the anchoring strap having a pair of anchoring pins and an elastic cord which is connected to and extends between the anchoring pins such that the anchoring pins are selectively extended into the anchoring holes to connect the anchoring strap to the foam tray wherein the anchoring pins further comprise a horizontal portion which mates with the elastic strap, a vertical portion which extends into the anchoring holes, and a bottom catch, connected to the vertical portion at a point thereon fully opposite from the horizontal portion, the bottom catch extending at an angle to the vertical portion to thereby prevent the anchoring pins from accidentally pulling upward out of the anchoring holes.

2. The tray assembly as recited in claim 1, wherein the tray assembly further comprises a bottle holder extending downward from the top surface of the foam tray.

3. The tray assembly as recited in claimed 2, wherein the bottle holder is a hollowed-out portion of the foam tray, having a circumference, and having radial slits extending outward from the circumference so as to allow the bottle holder to expand to accommodate bottles of varying sizes.

* * * * *